US006712538B1

(12) United States Patent
Green

(10) Patent No.: US 6,712,538 B1
(45) Date of Patent: Mar. 30, 2004

(54) FINGER MOUNTING SYSTEM FOR WRITING INSTRUMENTS

(76) Inventor: Leo Green, 660 Hwy. 45 N., Rienzi, MS (US) 38865

( * ) Notice: Subject to any disclaimer, the term of this patent is extended or adjusted under 35 U.S.C. 154(b) by 0 days.

(21) Appl. No.: 10/080,777

(22) Filed: Feb. 22, 2002

(51) Int. Cl.[7] ..... A46B 11/00
(52) U.S. Cl. ..... 401/48; 401/8
(58) Field of Search ..... 401/48, 7, 8, 131, 401/195, 52

(56) References Cited

U.S. PATENT DOCUMENTS

| | | | | |
|---|---|---|---|---|
| 36,652 | A | 10/1862 | Jacobs | |
| 198,484 | A | 12/1877 | Briggs | |
| 341,350 | A | 5/1886 | Rogers | |
| 365,810 | A | 7/1887 | Harris | |
| 657,370 | A | 9/1900 | Ward | |
| 915,892 | A | 3/1909 | Schafer | |
| 952,002 | A | 3/1910 | Dwinell | |
| 1,016,166 | A | 1/1912 | Marcucci | |
| 1,075,815 | A | 10/1913 | Chapman | |
| 1,206,976 | A | 12/1916 | Barth | |
| 1,544,971 | A | 7/1925 | Gadomski | |
| 1,577,272 | A | 3/1926 | Treadway | |
| 1,605,151 | A | 11/1926 | Wahl | |
| 1,655,330 | A | 1/1928 | Niznansky | |
| 1,681,842 | A | 8/1928 | Collen | |
| 1,797,103 | A | 3/1931 | Rustad | |
| 1,840,563 | A | 1/1932 | Brosius, Jr. | |
| 1,906,267 | A | 5/1933 | Hogg | |
| 2,273,044 | A | 2/1942 | Johnson | 120/103 |
| 2,422,642 | A | 6/1947 | Hornbeck | 2/250 |
| 2,515,741 | A | 7/1950 | Smith | 120/106 |
| 2,709,419 | A | 5/1955 | Appel | 120/103 |
| 3,005,441 | A | 10/1961 | Glasscock | 120/102 |
| 3,019,769 | A * | 2/1962 | Ballard | 401/7 |
| 3,075,498 | A | 1/1963 | Udcoff | 120/102 |
| 3,370,818 | A | 2/1968 | Perr | 248/205 |
| 3,402,984 | A | 9/1968 | Zazzara | 401/8 |
| D212,981 | S | 12/1968 | Laybourne | 74/17 |
| 3,596,964 | A | 8/1971 | Zazzara | 294/25 |

(List continued on next page.)

OTHER PUBLICATIONS

U.S. patent application Ser. No. 10,086,587, Ryoichi, filed Apr. 7, 1998.

U.S. patent application Ser. No. 11,123,891, Takeshi, filed May 11, 1999.

*Primary Examiner*—David J. Walczak
(74) *Attorney, Agent, or Firm*—Waddey & Patterson; Guy Hensley; Howard H. Bayless

(57) ABSTRACT

A system for mounting a writing instrument to a user's hand, comprising: at least one socket attachable to a side of the writing instrument; a ring member; and a connecting member secured to the ring member for separably coupling the ring member to the at least one socket. Alternatively, a writing system to be employed by the hand of a user, comprising: a writing instrument; at least one mortise portion integral to a side of the writing instrument; and a holding portion, the holding portion comprising a ring portion and an attaching portion, the ring portion being adapted to slidably receive and retain a finger of the user's hand, the attaching portion comprising a tenon adapted to be releasably attached to the at least one mortise portion, the attaching portion further comprising a connecting member for connecting the ring portion to the attaching portion. Alternatively, a kit for mounting a writing instrument to a user's hand, comprising: at least one socket attachable to a side of the writing instrument; a ring member; and a releasable fastener connecting the ring member to the at least one socket.

12 Claims, 15 Drawing Sheets

U.S. PATENT DOCUMENTS

| | | | | |
|---|---|---|---|---|
| D238,357 | S | 1/1976 | DiCarlo | 19/36 |
| D246,904 | S | 1/1978 | MacIntosh | 19/41 |
| 4,161,806 | A | 7/1979 | Hennisse et al. | 24/201 |
| 4,228,836 | A | 10/1980 | McFarland | 150/40 |
| D259,547 | S | 6/1981 | Texidor | 11/2 |
| 4,765,767 | A | 8/1988 | Marynissen et al. | 401/213 |
| 4,846,710 | A | 7/1989 | Campbell | 434/166 |
| 4,936,699 | A | 6/1990 | Yoshida | 401/48 |
| 5,405,206 | A | 4/1995 | Bedol | 401/7 |
| D389,185 | S | 1/1998 | O'Mara, et al. | |
| 5,722,575 | A | 3/1998 | Smith | 224/217 |
| 5,868,509 | A | 2/1999 | Crutcher | 401/8 |
| 5,885,018 | A | 3/1999 | Sato | 401/8 |
| 5,940,066 | A | 8/1999 | Weinblatt | 345/179 |
| 5,944,433 | A | 8/1999 | O'Mara et al. | 401/8 |
| 5,971,642 | A | 10/1999 | O'Mara et al. | 401/8 |

* cited by examiner

FINGER MOUNTING SYSTEM FOR WRITING INSTRUMENTS

A portion of the disclosure of this patent document contains material which is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

BACKGROUND OF THE INVENTION

The present invention relates generally to a system for mounting a writing instrument to a user's hand. More particularly, the present invention pertains to a device for releasably mounting a writing instrument on a finger of a user's hand, allowing the user to manipulate the writing instrument without losing grip on or dropping the writing instrument.

People have been using writing instruments for thousands of years. However, there has been a longstanding desire on the part of many to attach a writing instrument to the hand of a user without fear of the user's losing grip on or dropping the instrument.

Additionally, many patents have been issued relating to such writing instrument retention. Sometimes, the motivation for inventing in this area is to aid those who have difficulty in maintaining an adequate grip on a writing instrument due to health or other restrictions. Others invent in this area to lessen the likelihood that one would drop the instrument in a place where dropping the instrument would be inconvenient, such as into water or from an elevated position.

However, previous writing instrument retention devices do not allow for retainable attaching of a writing instrument to a user's hand in such a way that the user may adjust the retaining attachment to a discrete number of positions along the length of the writing instrument according to the personal preference and comfort of the user. Known writing instrument retention devices provide a finger ring joined to a writing instrument retention sleeve, and the writing instrument is slidably inserted into the sleeve in the practice of the invention. Unfortunately, one using such inventions is hampered by the fact that there is no way to reliably and consistently fix the writing instrument to writing instrument retention sleeve so that the writing instrument can be securely held therein.

What is needed, then, is a writing instrument retention system that adjustably allows a user to comfortably and securely hold a writing instrument.

SUMMARY OF THE INVENTION

The present invention relates generally to writing instrument retention devices. More specifically, the present invention is a device that allows a person to releasably secure a writing instrument to the person's hand. The device is made by attaching one or more sockets to a writing instrument, then by fixing a ring to the writing instrument by inserting a snap ball or similar device into one of the sockets.

Accordingly, it is an object of the invention to provide a writing instrument retention system that allows a user to releasably secure a writing instrument to the user's hand.

It is a further object of the invention to provide a system that allows a user to securely hold a writing instrument in the position that is most comfortable for the user.

It is a further object of the invention to provide a system that allows a writing instrument to be securely connected to a writing instrument retaining apparatus.

It is a further object of the invention to increase the pleasure of writing by physically supporting the finger that is used to secure the writing instrument.

In addition to the foregoing, further objects, features, and advantages of the present invention should become more readily apparent to those skilled in the art upon a reading of the following detailed description in conjunction with the drawings, wherein there are shown and described illustrated embodiments of the invention.

DESCRIPTION OF THE PREFERRED EMBODIMENTS

Figure 1:
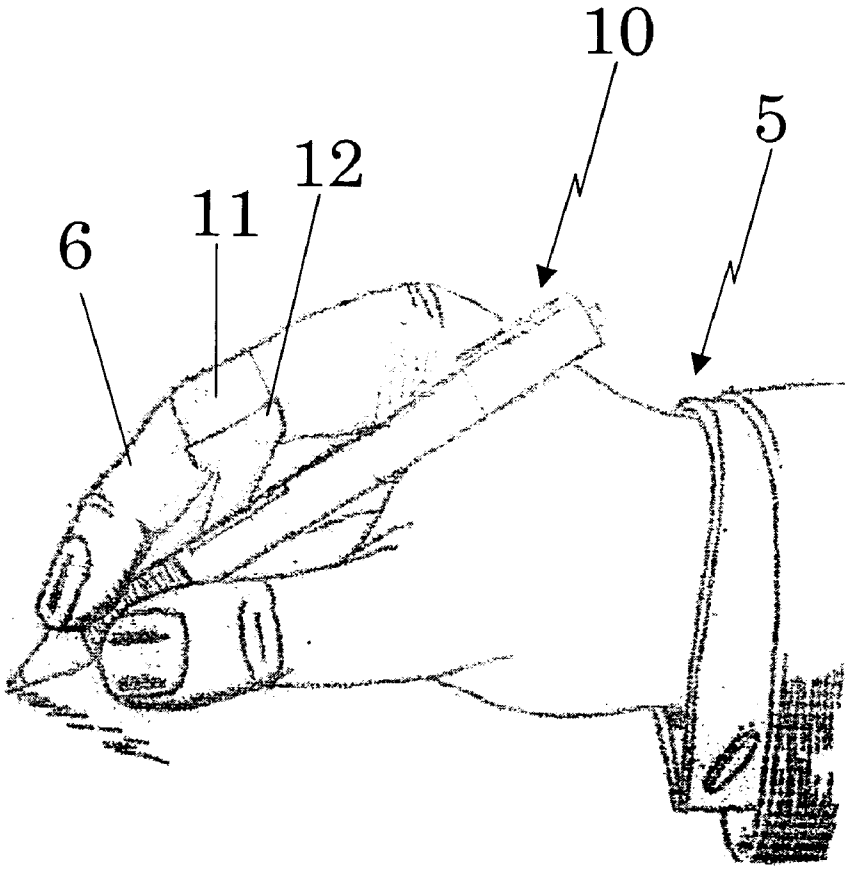
FIG. 1 is a side view of the system of the invention being used by a user to manipulate a writing instrument.

Referring to FIG. 1, the system of the invention is shown being employed by a user. The user's hand 5 is shown grasping writing instrument 10 in a conventional manner with the user's finger 6 inserted through a ring portion or ring member 11. Ring member 11 is preferably adjustable in circumference, so that ring member 11 can be sized to fit many different sizes of fingers, depending upon the user involved. Ring member 11 is of a poly waistband elastic braid construction such as that manufactured by Rhode Island Textile Co. of Pawtucket, R.I. Writing instrument 10 may be a pen, a pencil, or any known writing instrument. Connecting member 12 extends between ring member 11 and writing instrument 10, thereby allowing finger 6 to have a range of bending motion normally and naturally away from writing instrument 10. Connecting member 12 may be a fabric band, or may be a housing having internal supporting structures within it. Ring member 11 further is designed to receive finger 6 of the user slidably such that a user inserts finger 6 forwardly through ring member 11 toward the marking end of writing instrument 10.

Figure 2:
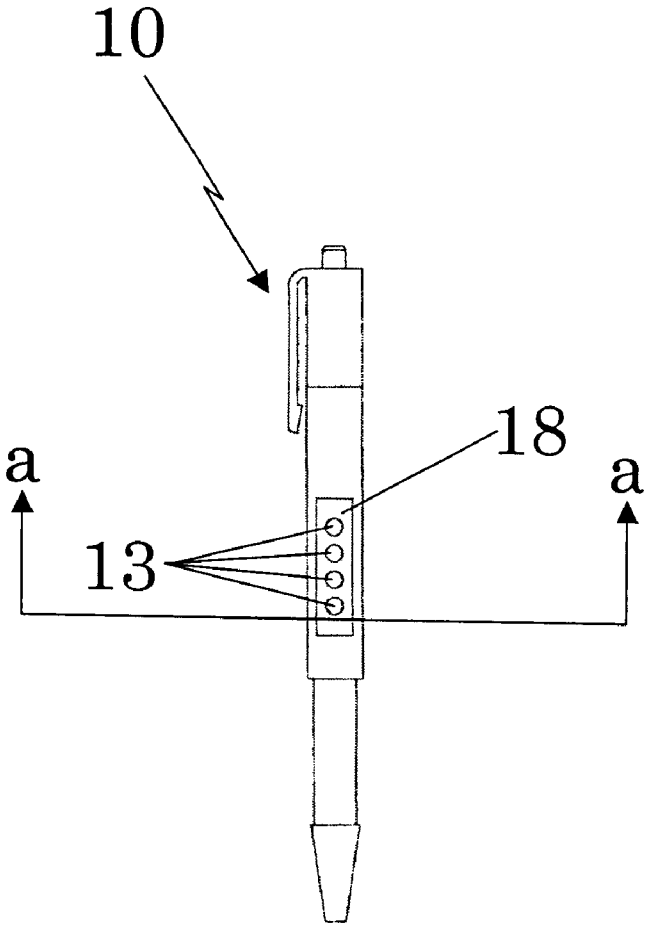
FIG. 2 is a plan view of a writing instrument to be used in the practice of the invention, showing a row of sockets or mortises attached or integral to the writing instrument.

Referring to FIG. 2, writing instrument 10 is shown with a number of female-type sockets 13 (also called "mortises") which are positioned on the side of writing instrument 10. Sockets 13 could be combined in a single panel 18 that is adhered, inset, or otherwise fixed to writing instrument 10. Alternatively, each socket 13 may be attached to the surface of writing instrument 10 or may be integrally formed therein. Furthermore, sockets 13 could be placed in various locations along the side of writing instrument 10 to accommodate the attachment thereto of ring member 11 and connecting member 12. In a preferred embodiment, panel 18 is made of a solid, one-piece construction, and is made of any of the following materials: plastic, acrylic, ABS plastic, SAN plastic, or easter copolyester, any of which may be procured from a company such as Eastman Chemical Co., Kingsport, Tenn.

Figure 3:
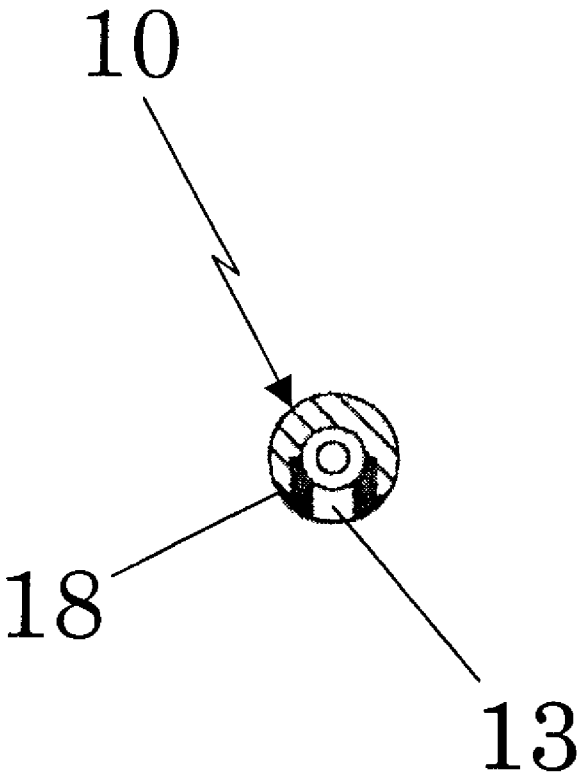
FIG. 3 is a cross-sectional view of the writing instrument shown in FIG. 2 along section line aa.

Referring to FIG. 3, writing instrument 10 is shown in cross sectional view along line aa of FIG. 2, with panel 18 inset. Panel 18 includes socket 13, and panel 18 is inset into writing instrument 10. While panel 18 is shown as being inset into the side of writing instrument 10, panel 18 could be attached to the exterior of the side of writing instrument 10 by any of a number of means, such as adhesive or a set of hook-and-loop fasteners. Any suitable attachment means could be employed to either releasably or non-releasably attach panel 18 to the side of writing instrument 10. Releasably attaching panel 18 to the side of writing instrument 10 would enable an embodiment of the invention to be sold as a kit for attaching a retention system to a writing instrument.

Figure 4:
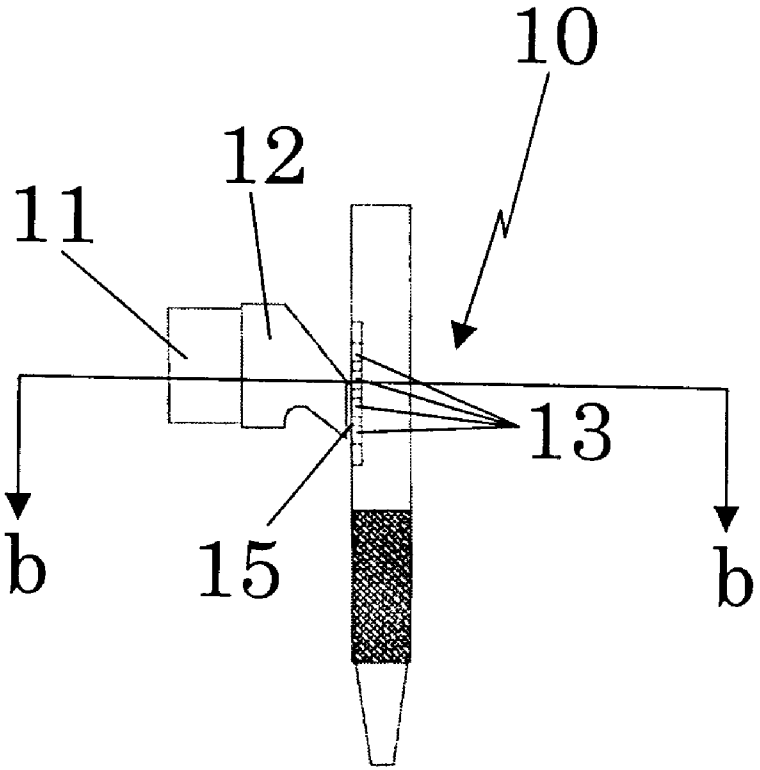
FIG. 4 is a side view of a writing instrument fitted with the system of the invention.

Referring to FIG. 4, writing instrument 10 is shown having ring member 11, connecting member 12 and connecting means (or attaching portion) 15 connected to writing instrument 10. Specifically, a male member-shaped snap ball 16 of connecting means 15 is inserted into one of sockets 13 on writing instrument 10. Snap ball 16 can be inserted into any of sockets 13. In the alternative, connecting member 12 could be attached to writing instrument 10 via a hook-and-loop connection.

Figure 5:
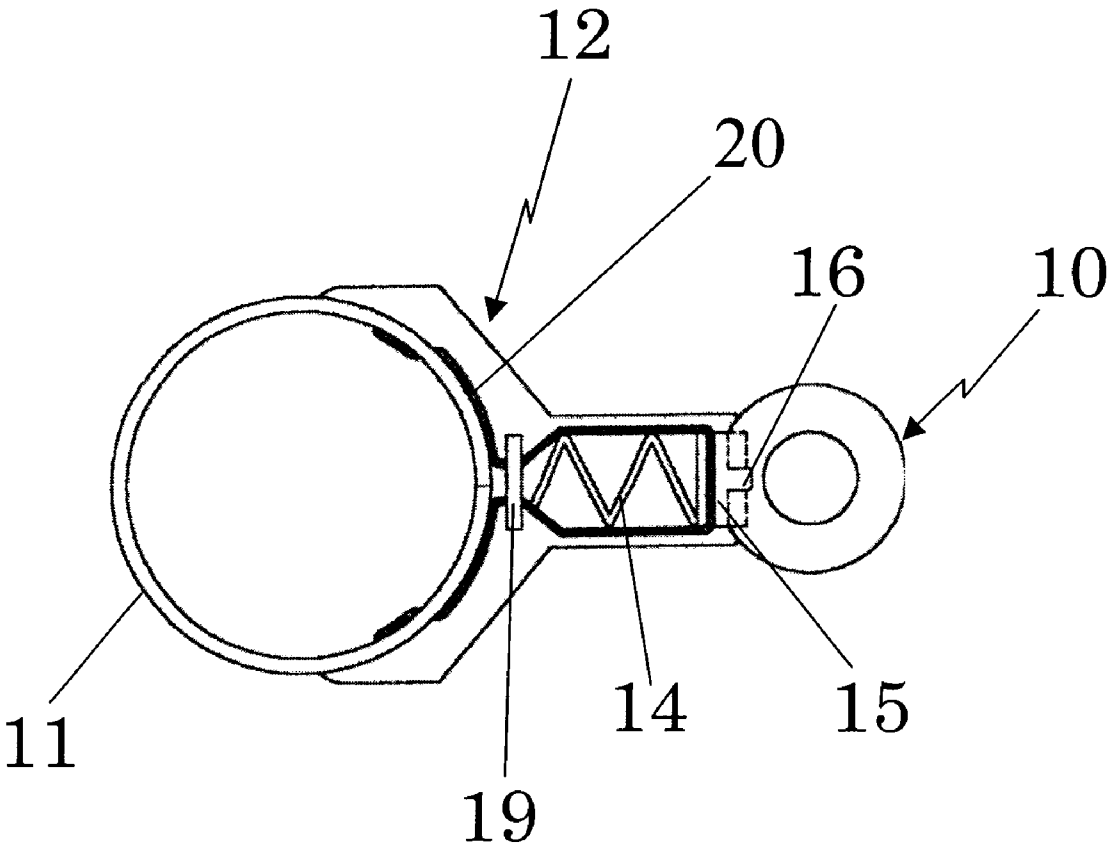
FIG. 5 is a cross-sectional view of the system of the invention shown in FIG. 4 along line bb.

Referring to FIG. 5, ring member 11 is shown in cross-sectional view along line bb of FIG. 4, attached to the side of writing instrument 10 via connecting member 12 and connecting means 15. The connecting member 12 is comprised of a proximal end and a distal end. The proximal end of the connecting member 12 attaches to the ring member 11. A male coupling member 16 is secured to the distal end for releasably connecting the coupling member 16 to one of the plurality of sockets. In a preferred embodiment, ring member 11 is sewn to a fabric braid 20 of the same manufacture as the fabric of ring member 11, although thinner (approximately ⅜"). Braid 20 may be made of any type of fabric or elastic suitable to provide a flexible connection between member 11 and writing instrument 10. Connecting member 12 may be of a solid construction, providing support for finger 6 as writing instrument 10 is being employed. Connecting member 12 may alternatively be made of cushion foam or ethylene vinyl acetate (EVA) sponge material, which may be procured from companies such as Glolink Corporation of Taipei, Taiwan.

Further referring to FIG. 5, a supporting structure such as coil spring 14 may be housed within braid 20 to provide structural support for finger 6 during the practice of the invention. A recommended coil spring is a 3/16"×1" 0.016" utility compression spring such as that manufactured by Century Spring Corp. of Los Angeles, Calif. Washer 19 is used to pinch and thus retain opposing sides of connecting means 15 together near ring member 11. A typical washer that is suitable as washer 19 is a #4 stainless steel washer (5/16"×⅛" dia.) such as that made by Atlantic Yuki Thailand Company of Samutrapakarn, Thailand may be used for such purpose. A male member 16 (also referred to as a "tenon" or "snap ball") is used to connect ring member 11 and connecting member 12 to writing instrument 10. In a preferred embodiment of the invention, male member 16 is a brass snap and studded post such as that manufactured by Grand Metal Works of Kowloon, Hong Kong.

Figure 6:
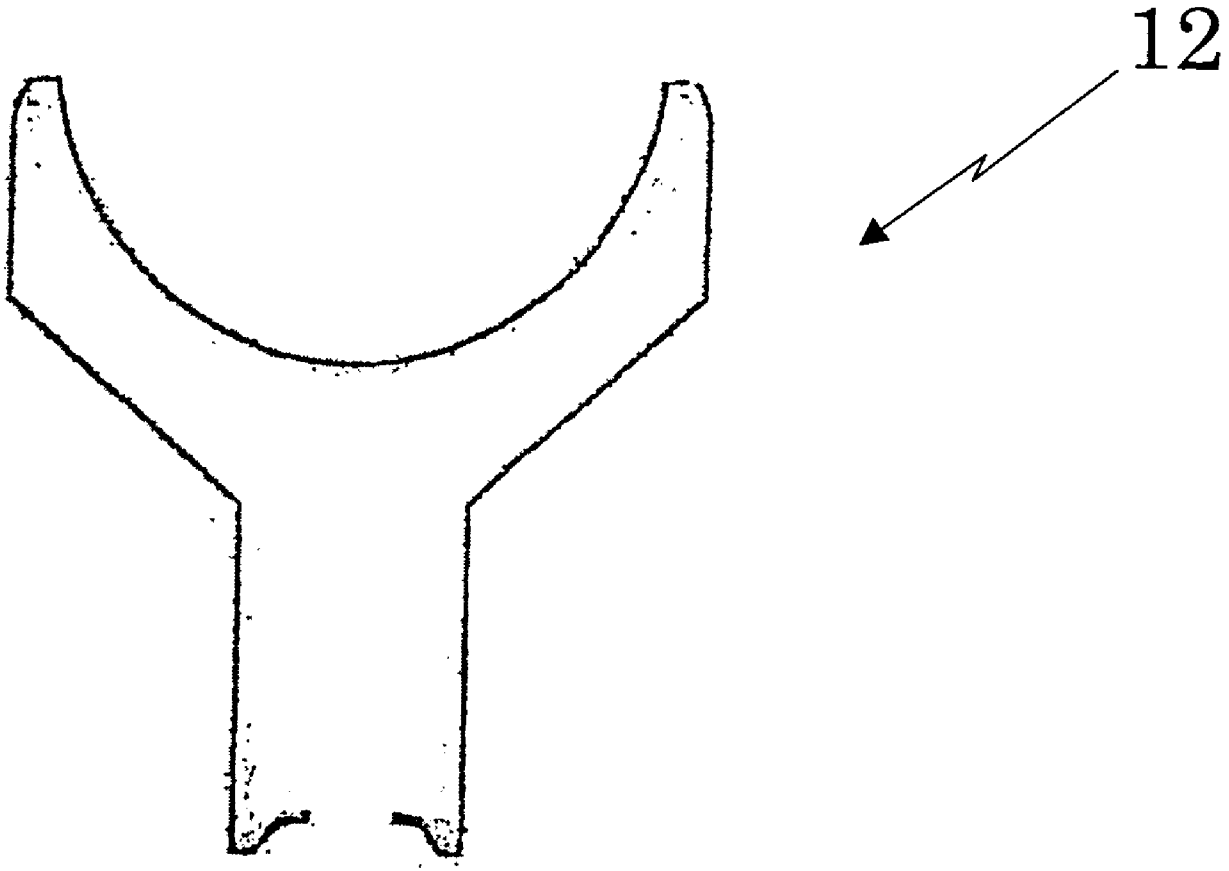
FIG. 6 is an end view of a portion of the connecting member of FIG. 5 used in the system of the invention.

Referring to FIG. 6, connecting member 12 may be of a solid construction. Connecting member 12 serves the function of supporting finger 6 comfortably, and may be made of the materials described above.

Figure 7:
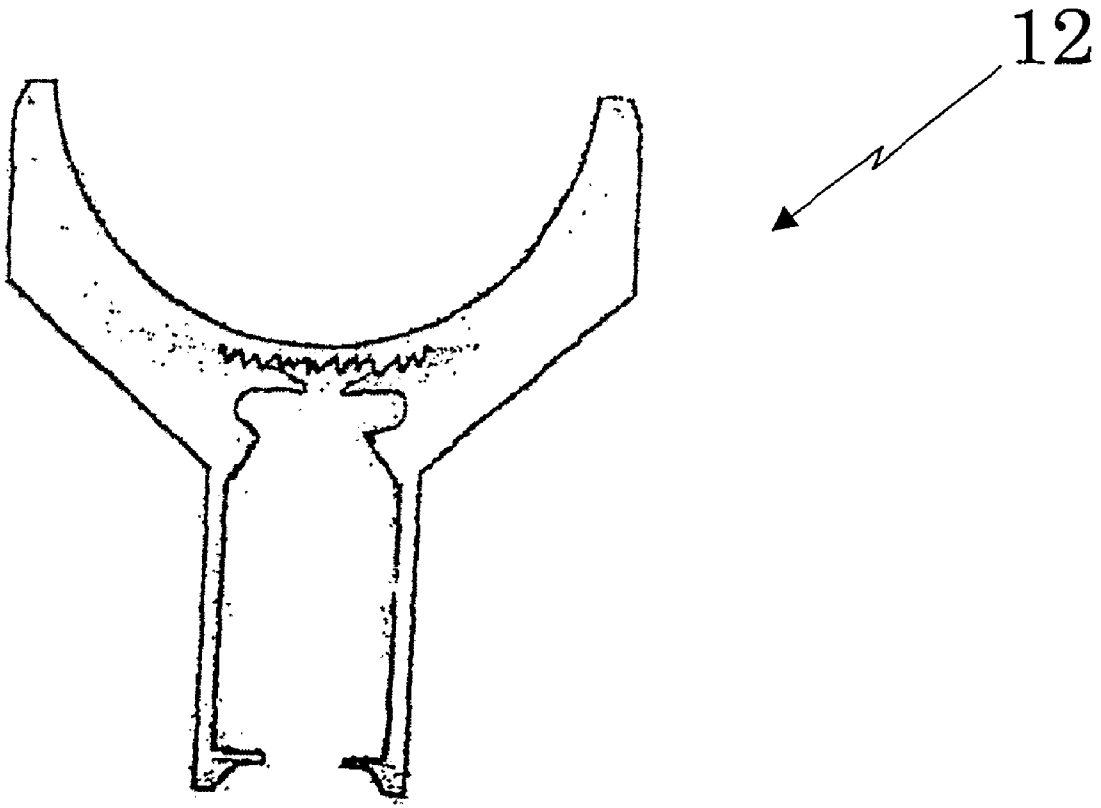
FIG. 7 is a cross-sectional view of the connecting member of FIG. 6.

Referring to FIG. 7, connecting member 12 may be a housing made of the same material as above, with a hollowed-out inner portion sufficient to hold a further supporting member such as supporting structure 14 within.

Figure 8:
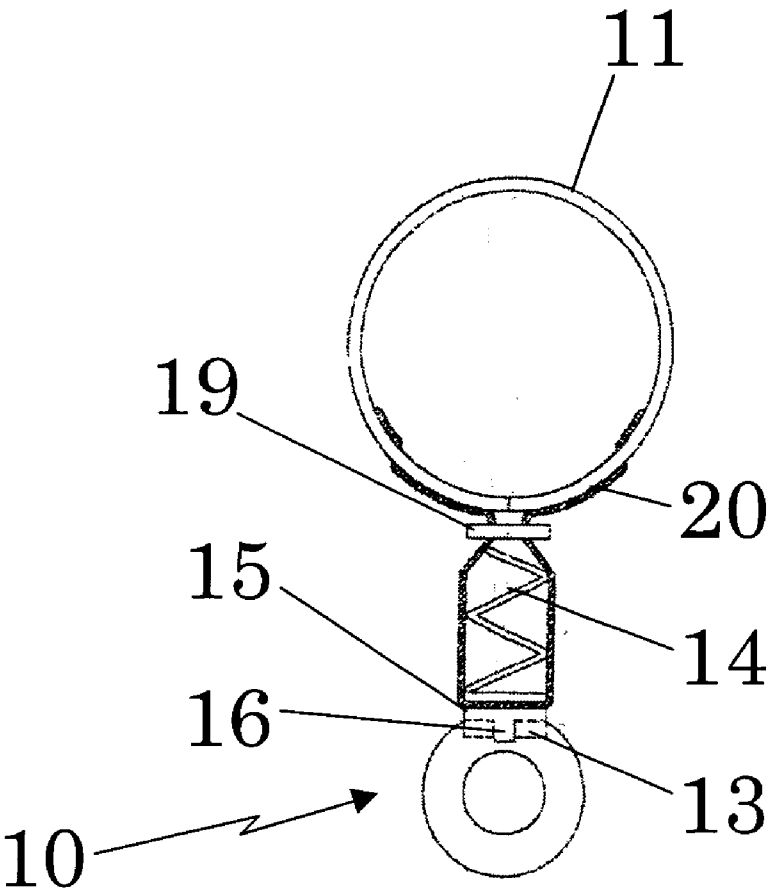
FIG. 8 is a cross-sectional view of the system of the invention shown in FIG. 5 with the connecting member of FIG. 6 removed.

Referring to FIG. 8, the system of the invention is shown as applied to writing instrument 10, with ring member 11 being woven to braid 20, braid 20 forming a housing around coil spring 14. Male member 16 is fixed to the end of connecting means 15 and, being inserted into a socket 13 of writing instrument 10, releasably connecting ring member 11 to writing instrument 10. All elements taken together, FIG. 8 discloses a writing system to be employed by the hand of a user, comprising a writing instrument 10, a ring portion being a braid 20, at least one mortise portion integral to a side of the writing instrument being one of the sockets 13; and a holding portion. The holding portion comprises the ring portion and an attaching portion. The ring portion being adapted to slidably receive and retain a finger of the user's hand. The attaching portion comprising a tenon, the tenon being the male member 16. The tenon is adapted to be releasably attached to the mortise portion. The attaching portion of the writing system further comprising a connecting member 15 for connecting the ring portion to the attaching portion.

Figure 9:
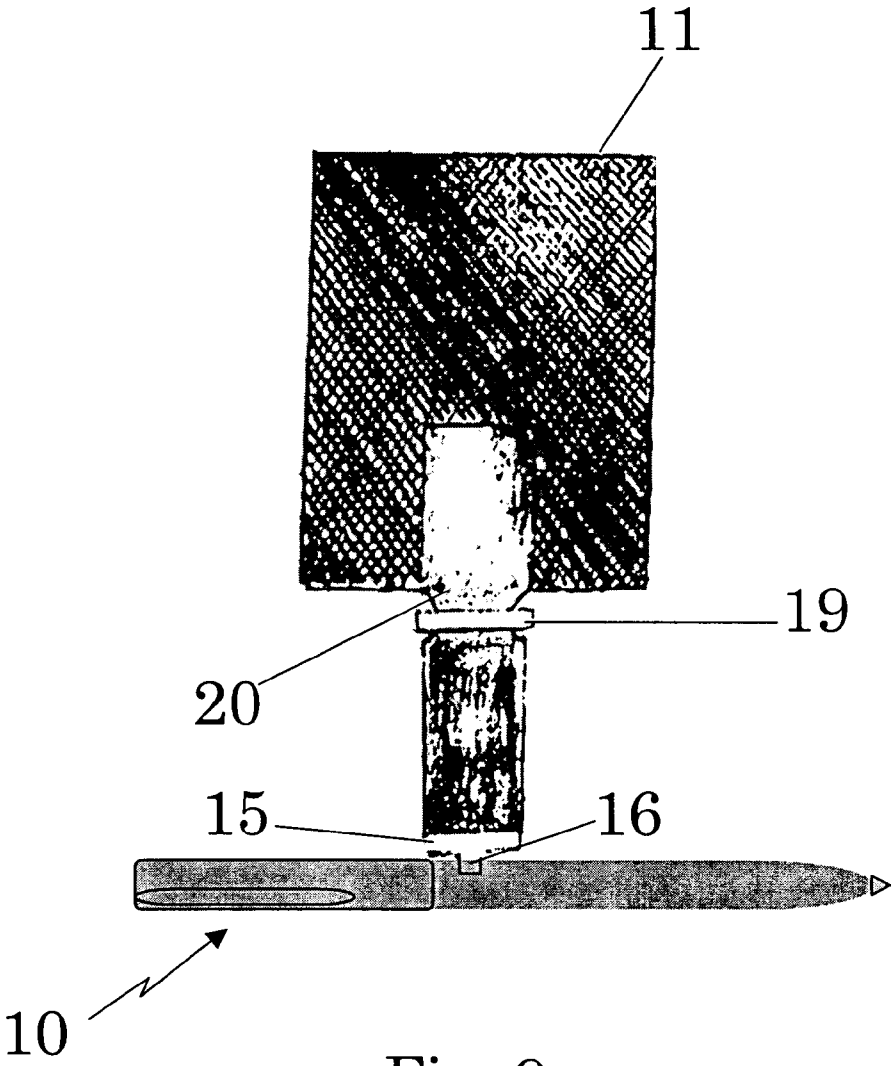
FIG. 9 is a side view of the system of the invention as shown in FIG. 8.

Referring to FIG. 9, ring member 11 is shown, fixed to connecting means 15 and braid 20 by sewing or other fixing method, washer 19 holding sides of connecting means together, and male member 16 is shown inserted into socket 13, which is integral to writing instrument 10.

Figure 10:
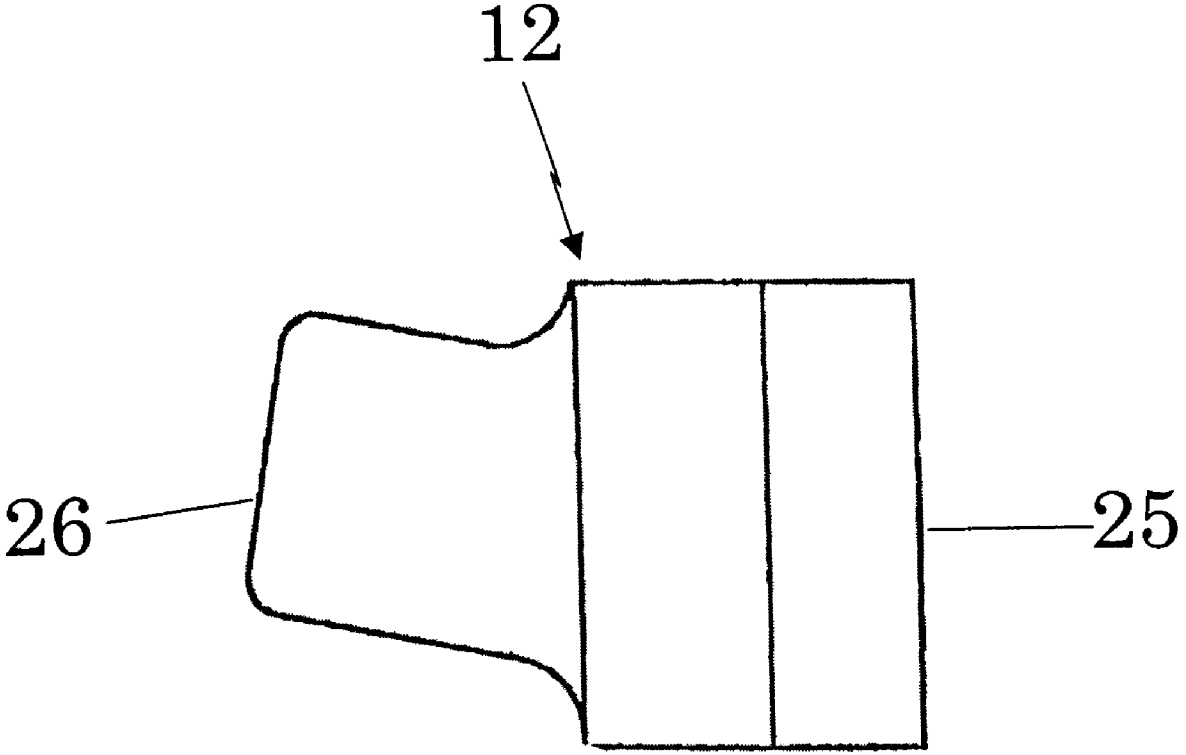
FIG. 10 is a side view of a second embodiment of the connecting member of the system of the invention.

Referring to FIG. 10, a second embodiment of connecting member 12 is shown. In a preferred embodiment, connecting member 12 is made of a resilient material such as EVA sponge. Connecting member 12 further has an upper end 25 suitable to receive ring member 11, and a lower end 26 to be attached to a male member 16, which is to be inserted into any of sockets 13.

Figure 11:
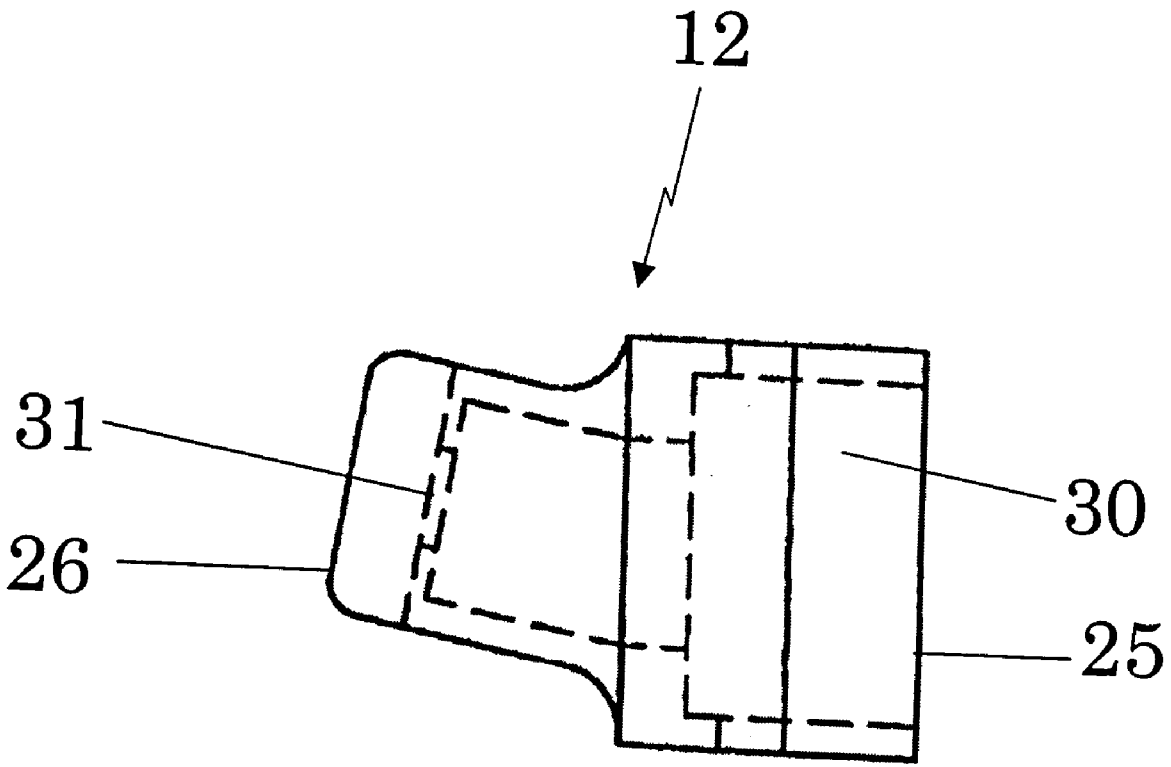
FIG. 11 is a side view of the connecting member of FIG. 10, with internal contours shown in ghost view.

Referring to FIG. 11, connecting member 12 as shown in FIG. 10 is shown, with inner contours shown in ghost view. In FIG. 11, it can be seen that an inner space 30 is provided within upper end 25 for receiving ring member 11, and that a lower space 31 is shown of dimensions sufficient to receive male member 16. In short, the system of the invention shown in FIG. 8 may be inserted into connecting member 12 and secured there in the practice of the invention.

Figure 12:
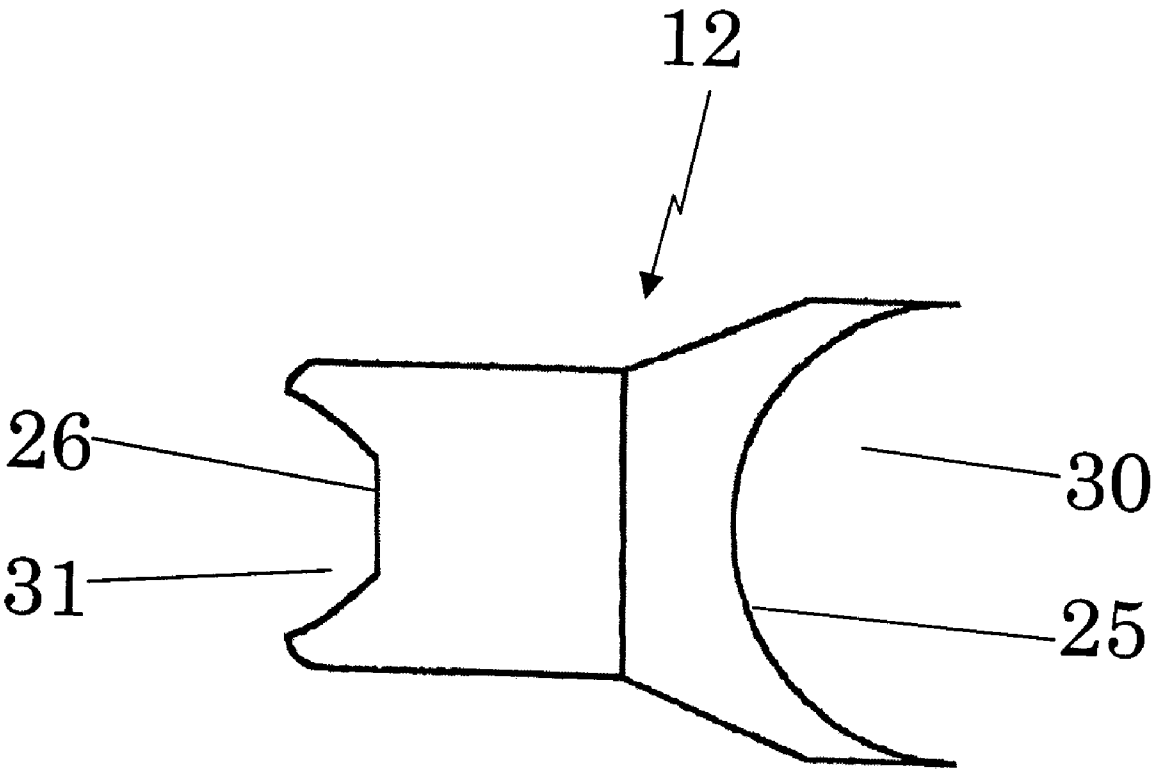
FIG. 12 is an end view of the connecting member of FIG. 10.

Referring to FIG. 12, connecting member 12 as shown in FIG. 10 is shown in end view. In FIG. 12, it can be again seen that an inner space 30 is provided within upper end 25 for receiving ring member 11, and that a lower space 31 is shown within lower end 26 of dimensions sufficient to receive male member 16.

Figure 13:
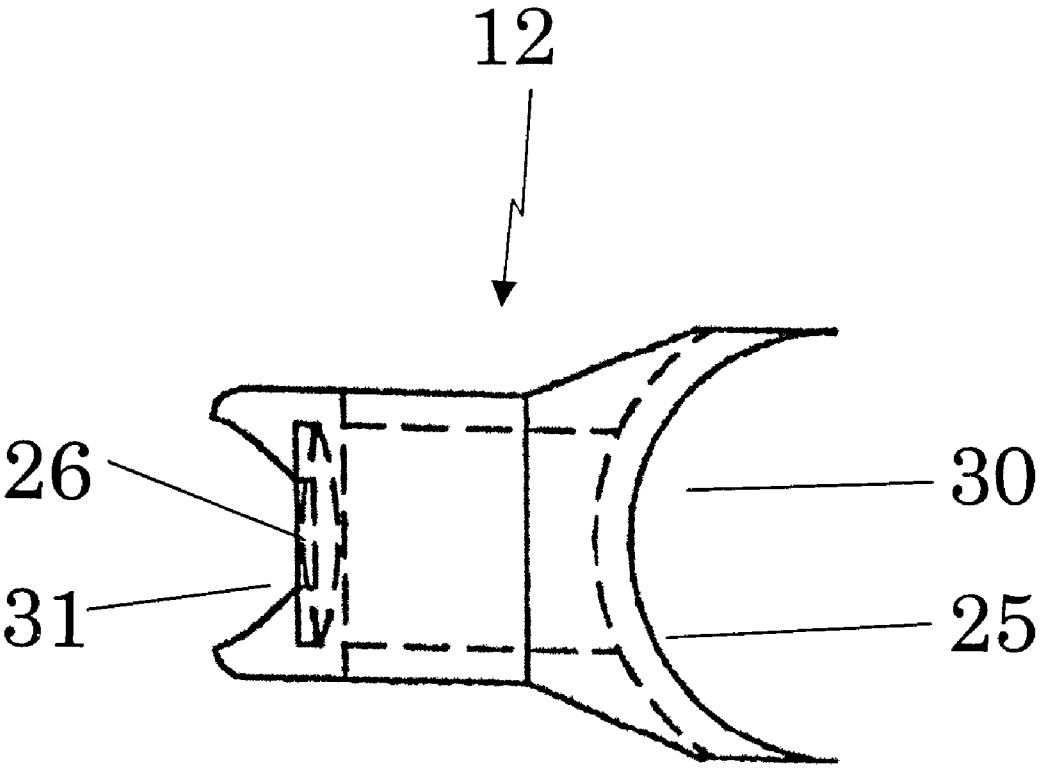
FIG. 13 is a view of the connecting member of FIG. 12, with internal contours shown in ghost view.

Referring to FIG. 13, connecting member 12 as shown in FIG. 12 is shown, with inner contours shown in ghost view. In FIG. 13, it can be seen that an inner space 30 is provided within upper end 25 for receiving ring member 11, and that a lower space 31 is shown within lower end 26 of dimensions sufficient to receive male member 16.

Figure 14:
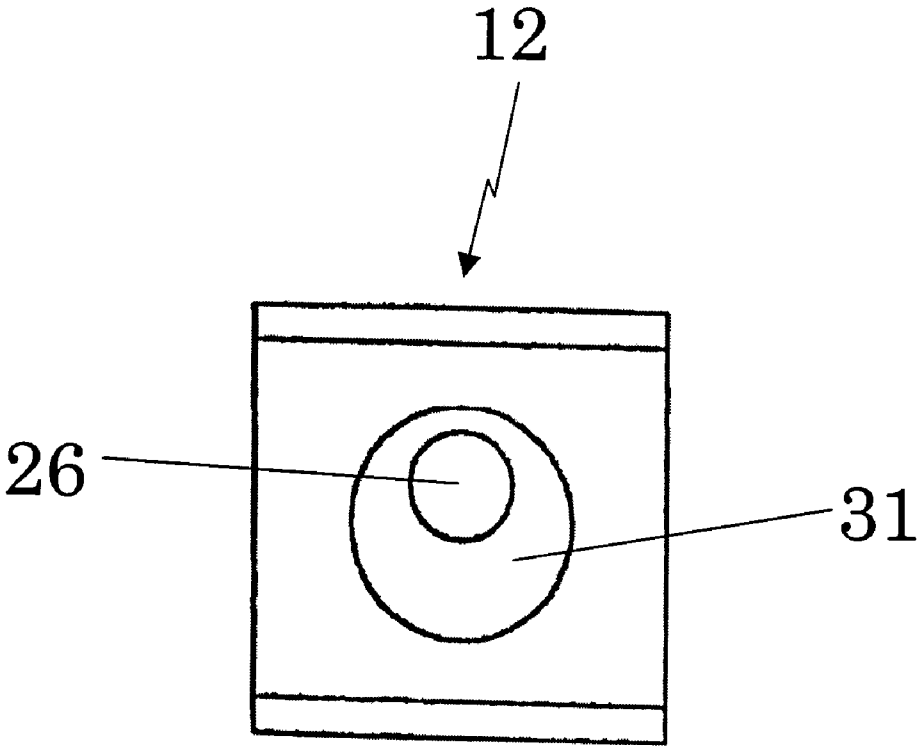
FIG. 14 is a top view of the connecting member of FIG. 10.

Referring to FIG. 14, connecting member 12 as shown in FIG. 10 is shown in top, view. In FIG. 14, it can be again seen that a lower space 31 is shown within lower end 26 of dimensions sufficient to receive male member 16.

Figure 15:
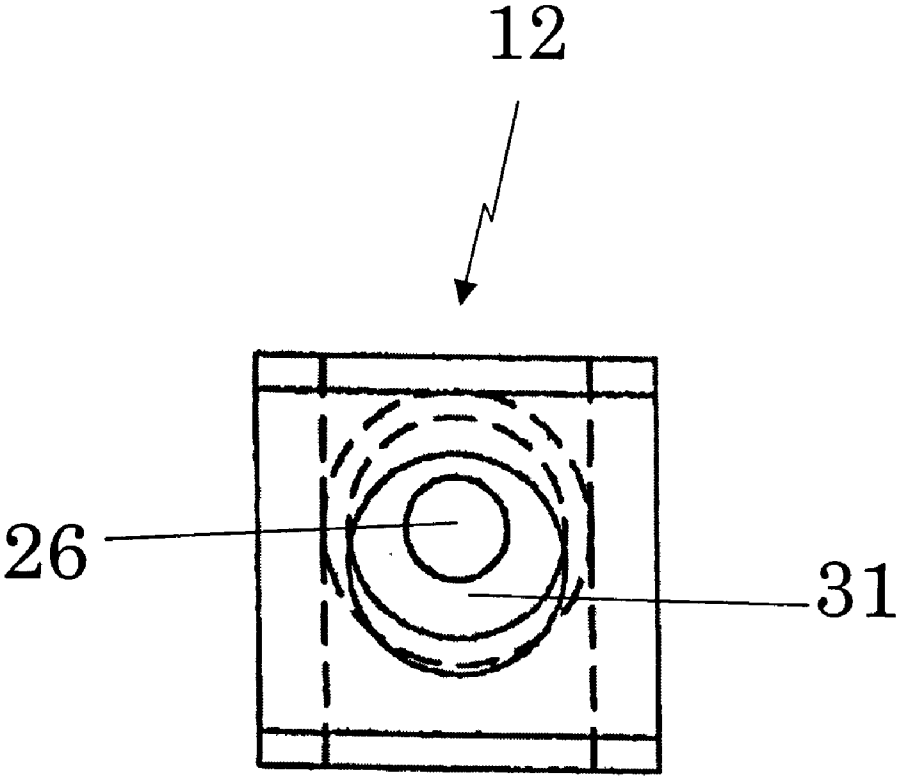
FIG. 15 is a view of the connecting member of FIG. 14, with internal contours shown in ghost view.

Referring to FIG. 15, connecting member 12 as shown in FIG. 14 is shown, with inner contours shown in ghost view. In FIG. 15, it can be seen that a lower space 31 is shown within lower end 26 of dimensions sufficient to receive male member 16.

Thus, although there have been described particular embodiments of the present invention of a new and useful "Finger Mounting System for Writing Instruments", it is not intended that such references be construed as limitations upon the scope of this invention except as set forth in the following claims.

I claim:

1. A system for mounting a writing instrument to a user's hand, comprising:

a writing instrument having a plurality of sockets integral to a side of the writing instrument;

a ring member; and a connecting member secured to the ring member for separably coupling the ring member to the at least one of the plurality of sockets.

2. The system of claim 1, wherein the ring member is circumferentially adjustable.

3. The system of claim 2, wherein the ring member is of an elastic material.

4. The system of claim 1, wherein the connecting member further comprises a spring housed within the connecting member.

5. The system of claim 4, wherein the spring is a coil spring.

6. The system of claim 1, wherein the connecting member further comprises a proximal end and a distal end, the proximal end attached to the ring member, and the distal end having a coupling member secured to the distal end for releasably connecting the coupling member to one of the plurality of sockets.

7. The system of claim 6, wherein the coupling member is a male-type member adapted to be releasably inserted into the at least one socket.

8. The system of claim 1, wherein the connecting member comprises a snap ball-type member adapted to be releasably inserted into the at least one socket.

9. The system of claim 1, wherein the connecting member comprises a resilient material.

10. The system of claim 1, wherein the connecting member comprises a supporting material.

11. The system of claim 1, wherein the connecting member is made of ethylene vinyl acetate.

12. A writing system to be employed by the hand of a user, comprising:

a writing instrument;

a plurality of mortise portions integral to a side of the writing instrument; and a holding portion, the holding portion comprising a ring portion and an attaching portion, the ring portion being adapted to slidably receive and retain a finger of the user's hand, the attaching portion comprising a tenon adapted to be releasably attached to any one of plurality of mortise portions, the attaching portion further comprising a connecting member for connecting the ring portion to the attaching portion.

* * * * *